US007659671B2

(12) United States Patent
Martin

(10) Patent No.: US 7,659,671 B2
(45) Date of Patent: Feb. 9, 2010

(54) HIGH-RELIABILITY LIGHT FIXTURE AND METHOD

(76) Inventor: Derek P. Martin, 10545 Daisy Rd., Carthage, MO (US) 64836

( * ) Notice: Subject to any disclaimer, the term of this patent is extended or adjusted under 35 U.S.C. 154(b) by 627 days.

(21) Appl. No.: 11/179,697

(22) Filed: Jul. 11, 2005

(65) Prior Publication Data

US 2007/0007911 A1 Jan. 11, 2007

(51) Int. Cl.
*H05B 37/02* (2006.01)

(52) U.S. Cl. ..... 315/209 R; 315/291; 315/323; 315/360; 340/479

(58) Field of Classification Search ..... 315/93, 315/200 A, 209 R, 291, 224, 225, 241 P, 315/307, 323, 360, DIG. 7; 340/479, 641, 340/642

See application file for complete search history.

(56) References Cited

U.S. PATENT DOCUMENTS 3,842,703 A * 10/1974 Okamoto et al. ..... 84/711
3,935,514 A * 1/1976 Ellin ..... 361/249
4,437,748 A * 3/1984 Kelly ..... 396/182
4,550,303 A * 10/1985 Steele ..... 340/458
5,955,945 A * 9/1999 Fuhrer ..... 340/479
6,278,382 B1 * 8/2001 DeMarco et al. ..... 340/981
6,828,739 B2 * 12/2004 Bruwer et al. ..... 315/291

* cited by examiner

*Primary Examiner*—Douglas W Owens
*Assistant Examiner*—Jimmy T Vu
(74) *Attorney, Agent, or Firm*—Martin & Associates, LLC; Derek P. Martin

(57) ABSTRACT

A light fixture includes multiple sets of light-producing devices, such as bulbs. A first set of bulbs is illuminated. When one or more bulbs in the first set of bulbs fails, the failure is detected, and a second set of bulbs is illuminated: If a number of good bulbs remaining falls below a predetermined threshold, the light fixture provides a notification that a bulb change is required. The notification may include visual, audio, or electronic notification. By providing multiple sets of bulbs and a controller to detect a bulb failure and automatically switch to a different set of bulbs, the light fixture and method of the preferred embodiments provide high-reliability lighting that automatically compensates when a bulb burns out.

3 Claims, 6 Drawing Sheets

HIGH-RELIABILITY LIGHT FIXTURE AND METHOD

BACKGROUND OF THE INVENTION

1. Technical Field

This invention generally relates to light fixtures, and more specifically relates to light fixtures for high-reliability applications.

2. Background Art

Light fixtures have been designed for many different applications. Some lighting applications require constant illumination. For example, prisons, hospitals, and secure areas may have a need for constant illumination. Having a bulb burn out in an area that requires constant illumination may impact the safety and security of the area. Known light fixtures may contain multiple bulbs, but all of the bulbs are lit at the same time. Known light fixtures have no way to detect when a bulb fails, and to compensate for the bulb failure. Without a way to detect bulb failure and switch to a good bulb, high-reliability lighting applications will continue to suffer from fixtures that do not compensate for a failed bulb.

DISCLOSURE OF INVENTION

According to the preferred embodiments, a light fixture includes multiple sets of light-producing devices, such as bulbs. When one or more bulbs in the first set of bulbs fails, the failure is detected, and a second set of bulbs is illuminated. If a number of good bulbs remaining falls below a predetermined threshold, the light fixture provides a notification that a bulb change is required. The notification may include visual, audio, or electronic notification. By providing multiple sets of bulbs and a controller to detect a bulb failure and automatically switch to a different set of bulbs, the light fixture and method of the preferred embodiments provide high-reliability lighting that automatically compensates when a bulb burns out.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements, and.

BEST MODE FOR CARRYING OUT THE INVENTION

A high-reliability light fixture includes multiple sets of bulbs, with one or more sets illuminated and one or more sets not illuminated, but held in reserve. A bulb controller detects failure of one or more bulbs in the first set of bulbs, and automatically illuminates one or more bulbs in the second set of bulbs to compensate for the failure. When a number of reserve bulbs falls below a predetermined threshold, a warning may be provided that one or more failed bulbs need to be replaced. The bulb controller also includes a test mode to cycle power to the different bulb sets so a repair technician can easily determine which bulbs need to be replaced.

Figure 1:
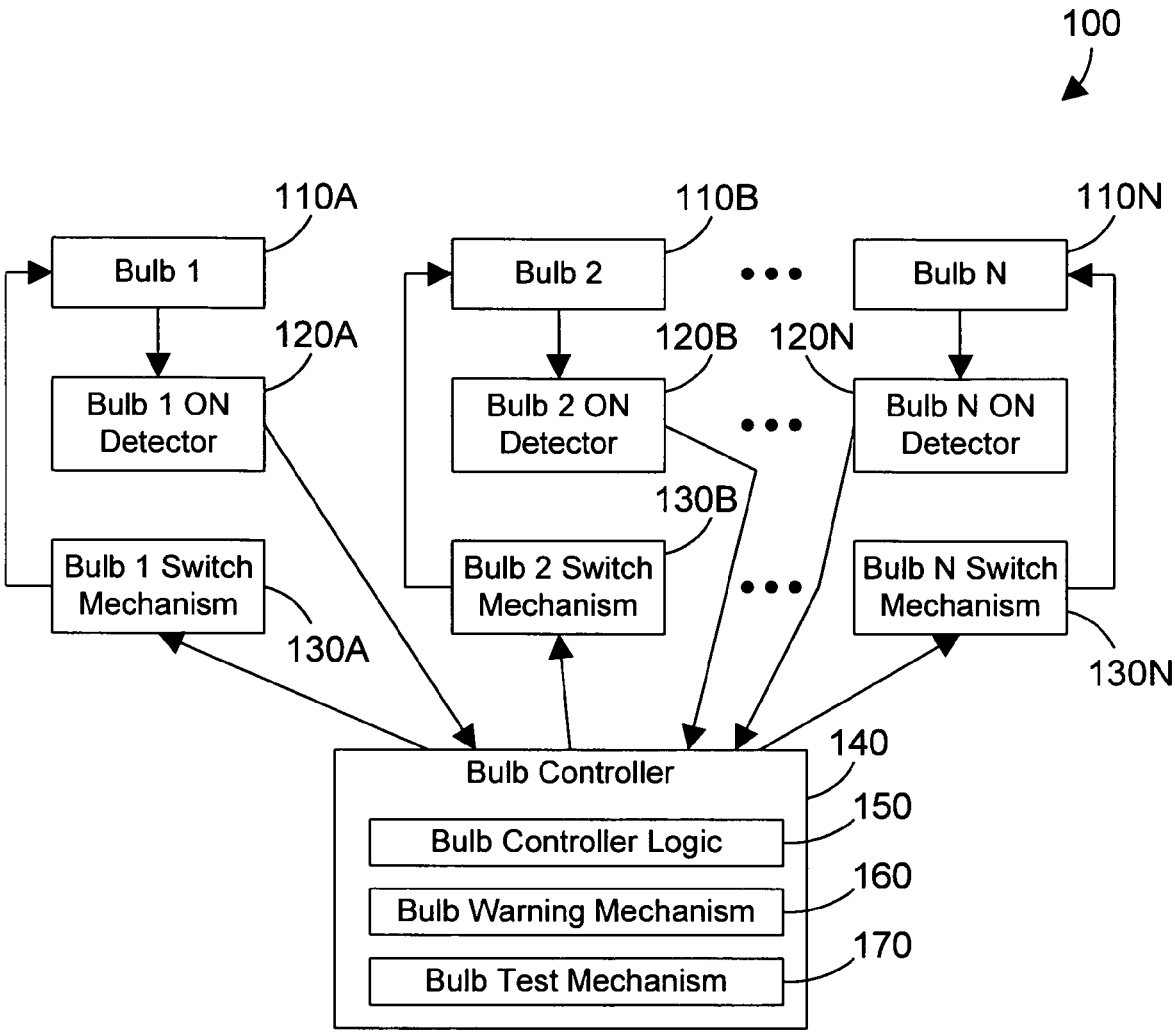
FIG. 1 is a block diagram of a light fixture in accordance with the preferred embodiments.

Referring to FIG. 1, a light fixture 100 in accordance with the preferred embodiments includes multiple bulbs 110A, 110B, . . . , 110N that are each illuminated via a corresponding switch mechanism 130A, 130B, . . . , 130N. Each bulb has a corresponding detector 120A, 120B, . . . , 120N that detects when the bulb is illuminated. A bulb controller 140 monitors the bulb on detectors 120A, 120B, . . . , 120N, and selectively controls the bulb switch mechanisms 130A, 130B, . . . , 130N according to bulb control logic 150. In the preferred embodiments, one or more bulbs are initially illuminated, and one or more bulbs are held in reserve by not being illuminated. The bulb controller 140 detects when one or more illuminated bulbs fails, and in response, automatically illuminates one or more of the reserved bulbs to compensate for the failed bulb (s). In this manner, the light fixture 100 automatically compensates for a bulb failure and continues to provide full light output even when a bulb fails.

Bulb controller 140 includes bulb control logic 150, bulb warning mechanism 160, and bulb test mechanism 170. Bulb controller logic 150 specifies which bulbs to initially illuminate, specifies which bulbs are to illuminate when one of the initially-illuminated bulbs fails, and specifies when to provide a warning that a bulb has gone out. The bulb warning mechanism 160 is an interface to a provide a suitable warning, such as a visible indicator, audio indicator, or electronic message. The bulb test mechanism 170 may receive a command to put the bulb controller 140 in a bulb test mode. The bulb test mechanism 170 may be activated by a user pushing a button, by the bulb test mechanism 170 receiving an electronic message, or by detecting any other suitable indication that a bulb test mode should be executed. The bulb test mechanism 170, in response to a user putting the bulb controller 140 in a bulb test mode, will iteratively apply power to each bulb in a defined sequence. For example, a service technician could determine from the bulb warning mechanism 160 that one or more bulbs have failed and need to be replaced. When the technician accesses the interior of the light fixture, the technician could push a button that activates the bulb test mechanism 170. In response, the bulb test mechanism 170 applies power to each bulb in a defined sequence. This allows the technician to visually determine which bulb or bulbs need to be replaced. The bulb test mechanism 170 can exit bulb test mode by the technician pressing the bulb test button a second time, or by simply executing the bulb test mode for a specified time before returning to normal operating mode.

Bulb controller 140 may be a hardware controller, such as a state machine, or could be any suitable combination of hardware and software, such as a microprocessor with suitable programming. In addition, bulb controller 140 may include any suitable number and type of programmable devices, including programmable logic devices, programmable gate arrays, and memory devices. In sum, bulb controller 140 may be implemented in any suitable combination of hardware and/or software within the scope of the preferred embodiments.

The term "bulb" is used herein in its broadest sense to expressly include any light-producing device, whether currently known or developed in the future. Examples of known light-producing devices, include incandescent bulbs, fluorescent bulbs, high-pressure sodium bulbs, halogen bulbs, metal halide and other high-intensity discharge bulbs, cathode ray tubes, light-emitting diodes (LEDs), and electro-luminescent (EL) panels. Note that multiple light-producing devices may be included within a single device within the scope of the preferred embodiments. For example, an incandescent light bulb could have multiple filaments, with each filament having an independent connection in a suitable light socket. In this arrangement, a first filament could be initially illuminated, and when the first filament fails, a second filament in the same bulb could be illuminated. In this configuration, the first filament and second filament are separate light producing devices within the scope of the present invention.

Figure 2:
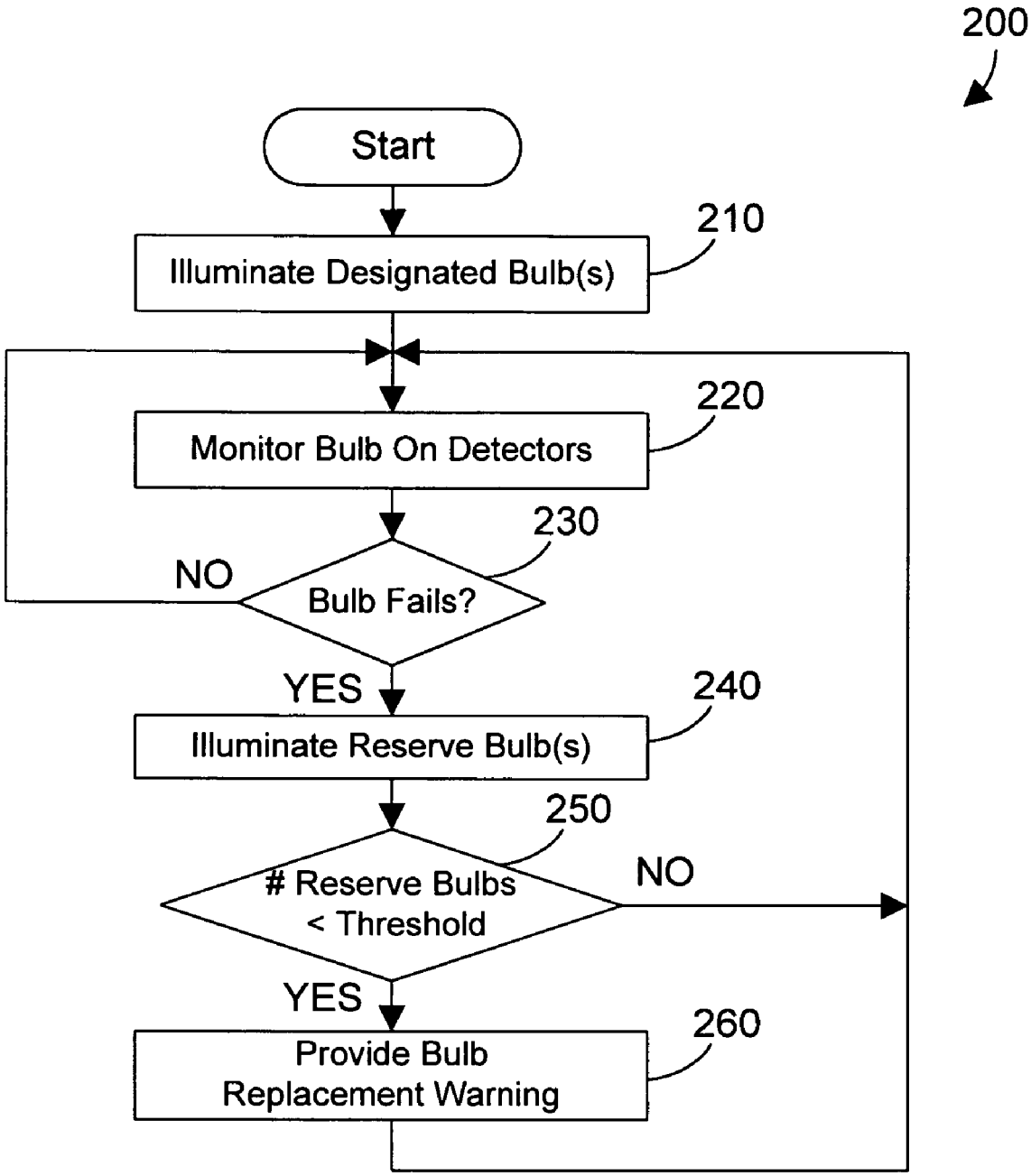
FIG. 2 is a flow diagram of a method in accordance with the preferred embodiments for the bulb controller of FIG. 1.

The bulb controller 140 functions according to bulb control logic 150. One suitable implementation of bulb control logic 150 is shown as method 200 in FIG. 2. First, designated bulbs are illuminated (step 210). The bulb on detectors for the illuminated bulbs are monitored (step 220). As long as no bulb fails (step 230=NO), method 200 loops back to step 220 and continues. When one or more of the illuminated bulbs fails (step 230=YES), one or more of the reserve bulbs is illuminated (step 240). If the number of reserve bulbs falls below a predetermined threshold (step 250=YES), a warning is provided that one or more bulbs need to be replaced (step 260). Method 200 then loops back to step 220 and continues. If the number of reserved bulbs is not less than the predetermined threshold (step 250=NO), method 200 loops back to step 220 without providing the warning in step 260.

Note that the number of bulbs initially illuminated, the number of reserve bulbs, and the predetermined threshold may vary within the scope of the preferred embodiments. For example, a light fixture could include one bulb that is initially illuminated, with two reserve bulbs, and a predetermined threshold of one bulb. With this configuration, the single bulb that is initially illuminated will remain illuminated until it fails. Once the first bulb fails, the second bulb is illuminated. Because there is still one reserve bulb left, and because the predetermined threshold is one, no warning is given. When the second bulb fails, the third bulb is illuminated. Because there are no reserve bulbs left, the number of reserve bulbs (zero) is less than the threshold of one bulb, so a warning is provided to indicate that the failed bulbs need to be replaced.

The warning that is provided when the number of reserve bulbs is less than the predetermined threshold may be in any suitable form. For example, a small red or green light-emitting diode (LED) may be placed in the light fixture in a location that is easily observed by someone looking at the light fixture. A maintenance technician could then determine from the illuminated LED that one or more bulbs need to be replaced. Of course, the LEDs could be made to blink or flash as well as being lit continuously. Another suitable warning is an audible warning produced by a suitable audio transducer. For example, a piezoelectric buzzer could be used, and the bulb warning mechanism 160 could activate the piezoelectric buzzer for a short duration to cause an audible "chirp" once per minute. Another suitable warning is an electronic message to a computer system that monitors many light fixtures. The message could be logged to provide a list of light fixtures that have bulbs that need to be replaced to a maintenance technician. This would be especially useful in a large installation, such as a prison or hospital, that includes a system to monitor different areas. Each light fixture could be wired to the central monitoring station to report bulb failures so scheduled maintenance can be performed to replace failed bulbs while reserve bulbs are still illuminated. The result is a high-reliability light fixture that automatically switches to a good bulb when a bulb fails, and that automatically signals when failed bulbs need to be replaced.

A bulb on detector (e.g., 120A, 120B, . . . , 120N in FIG. 1) within the scope of the present invention comprises any suitable detector for determining when a bulb is turned on, whether currently known or developed in the future. One example of a known bulb on detector is a low-value current sense resistor placed in series with a bulb, with the current sense resistor coupled to an operational amplifier configured as a Schmitt Trigger with a threshold that provides one logic state on the output when the bulb is on and functioning properly, and a different logic state when the bulb is off. The bulb controller 140 can thus determine from the logic state of the output of the Schmitt Trigger whether the bulb is on or off. A current sense resistor/Schmitt Trigger bulb on detector is well-suited to detecting whether an incandescent bulb is on or off.

Another example of a bulb on detector is a light detector. One suitable light detector is a variable resistor which has a resistance that varies with the amount of light that shines on a small window or other defined region of the variable resistor. This type of light detector is often used on night lights to turn on the night light automatically when the light in the room falls below some threshold value. Such a light detector could be used in a voltage divider circuit to provide one logic state when the bulb is functioning properly and a different logic state when the bulb is not functioning properly. In the alternative, the voltage across the variable resistor could be input into a Schmitt Trigger that has a threshold set so that normal light output from the bulb causes a first logic state on the output of the Schmitt Trigger and below-normal light output from the bulb causes a second logic state on the output of the Schmitt Trigger. Because a fluorescent bulb can dim when it fails instead of completely turning off, and because a light detector can detect reduced light output as a bulb failure, a light detector is well-suited to detecting failure of a fluorescent bulb. Of course, a light detector could also be used with an incandescent bulb or other types of light-producing devices as well.

A bulb switch mechanism (e.g., 130A, 130B, . . . , 130N in FIG. 1) within the scope of the present invention comprises any suitable mechanism for turning a bulb on and off under control of the bulb controller 140, whether currently known or developed in the future. Examples of suitable known bulb switch mechanisms include mechanical relays, solid state relays, transistors, silicon-controlled rectifiers, and triacs.

Figure 3:
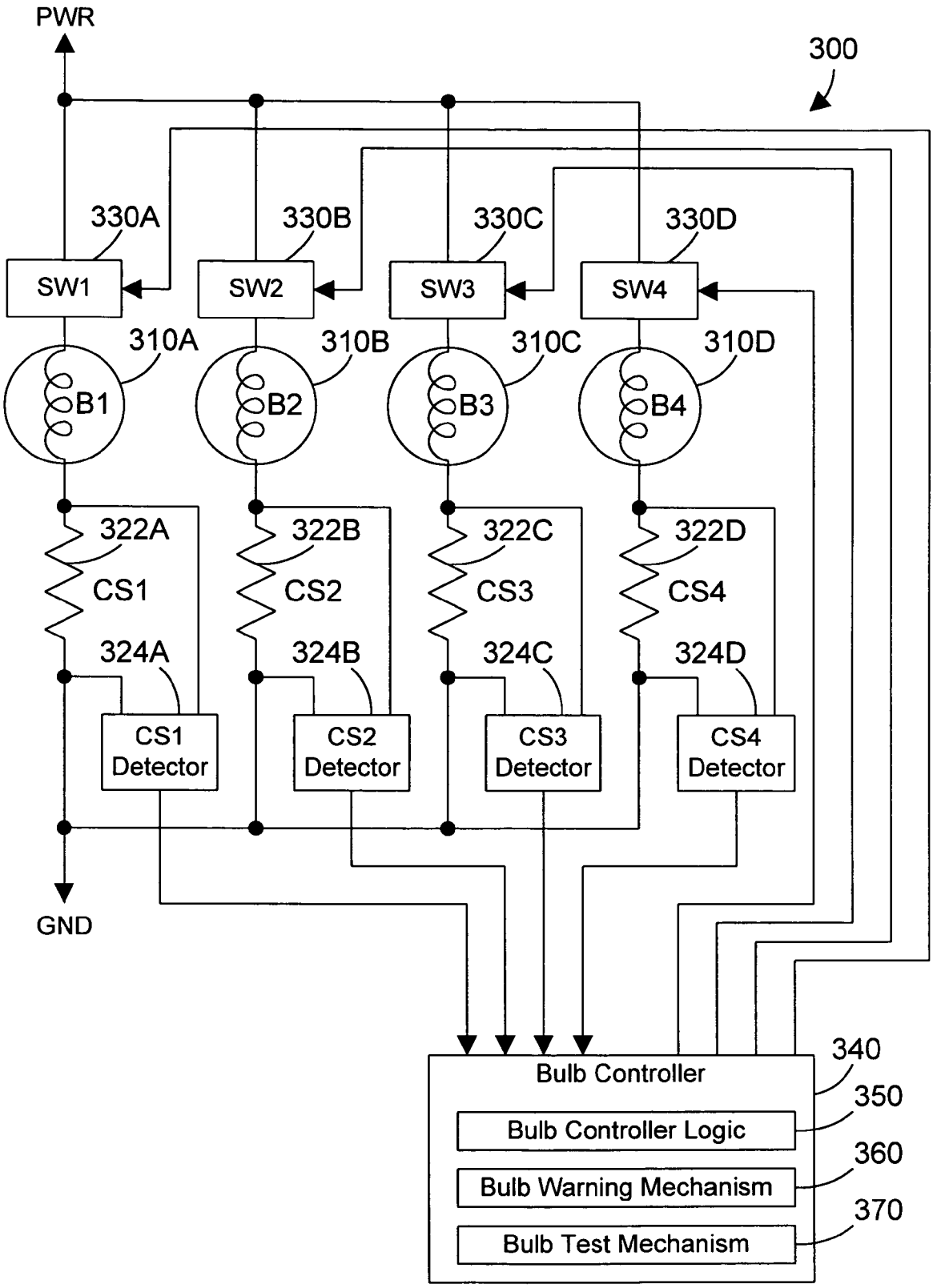
FIG. 3 is a block diagram of a light fixture for incandescent bulbs in accordance with the preferred embodiments.
Figure 4:
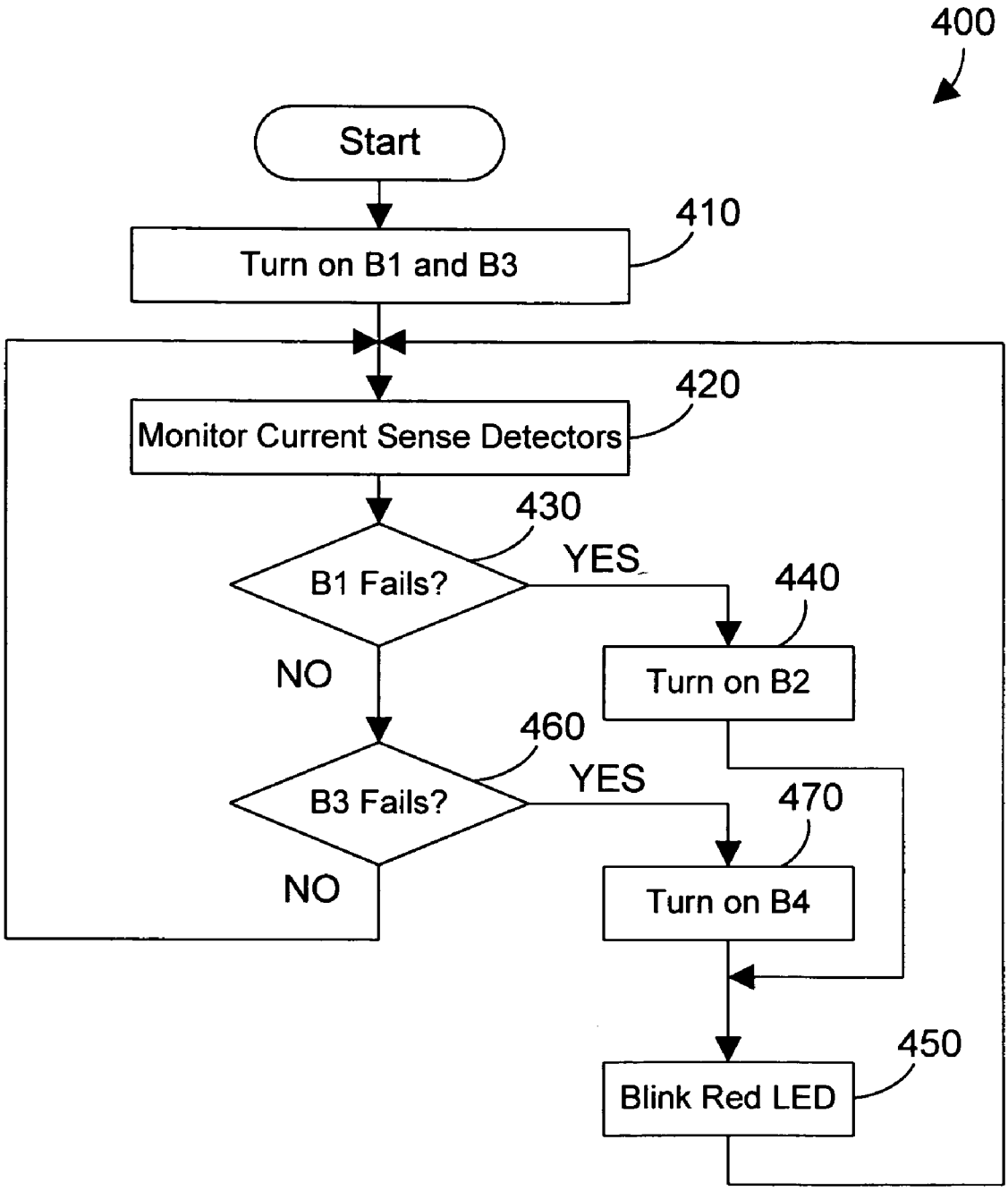
FIG. 4 is a flow diagram of a method in accordance with the preferred embodiments for the bulb controller of FIG. 3.

FIGS. 3 and 4 show one sample light fixture and method for incandescent bulbs. Referring to FIG. 3, a light fixture 300 includes four incandescent bulbs 310A, 310B, 310C and 310D. We assume for this example that bulbs 310A and 310C are initially illuminated. We further assume that bulb 310B is a reserve bulb for bulb 310A, and bulb 310D is a reserve bulb for bulb 310C. Each bulb has a corresponding switch mechanism for illuminating the bulb, and a corresponding current sense resistor coupled to a corresponding current sense detector. Thus, bulb 310A is coupled to a switch mechanism 330A and to a current sense resistor 322A that is coupled to a current sense detector 324A. In like manner, bulb 310B is coupled to a switch mechanism 330B and to a current sense resistor 322B that is coupled to a current sense detector 324B; bulb 310C is coupled to a switch mechanism 330C and to a current sense resistor 322C that is coupled to a current sense detector 324C; and bulb 310D is coupled to a switch mechanism 330D and to a current sense resistor 322D that is coupled to a current sense detector 324D.

Switch mechanisms 330A, 330B, 330C and 330D are coupled to and controlled by bulb controller 340. Current sense detectors 324A, 324B, 324C and 324D have outputs coupled to bulb controller 340. The bulb controller 340 monitors the outputs of the current sense detectors 324A-324D, and selectively activates the switches 330A, 330B, 330C and 330D according to bulb control logic 350. As stated above, we assume that bulb control logic 350 specifies that bulbs 310A and 310C are initially illuminated, with bulbs 310B and 310D being reserve bulbs for bulbs 310A and 310C, respectively. If bulb 310A fails, the current through the current sense resistor 322A will stop flowing, which will cause the output of the current sense detector 324A to change state to indicate that bulb 310A has failed. When bulb controller 340 detects from current sense detector 324A that bulb 310A has failed, the bulb controller 340 activates the switching mechanism 330B to illuminate the reserve bulb 310B. In similar fashion, when bulb controller 340 detects from current sense detector 324C that bulb 310C has failed, bulb controller 340 activates the switching mechanism 330D to illuminate the reserve bulb 310D. We assume for this example that bulb switch logic 350 specifies to provide a warning of a bulb failure whenever any bulb fails. Thus, when the first of bulb 310A and 310C fails, the bulb warning mechanism 360 will provide a suitable warning that a bulb needs to be replaced. As explained in more detail above, examples of suitable warnings include the illumination of a visual indicator, the sounding of an audible indicator, and the sending of an electronic message.

A method 400 in accordance with the preferred embodiments for the bulb controller logic 350 of FIG. 3 is shown in FIG. 4. Method 400 begins by turning on bulbs B1 and B3 (step 410). This is done by the bulb controller 340 activating the switches 330A and 330C to provide power to the bulbs B1 and B3. The state of the current sense detectors 324A and 324C indicate that bulbs B1 and B3 are illuminated, while the state of the current sense detectors 324B and 324D indicate that bulbs B2 and B4 are off. The outputs of the current sense detectors 324A-324D are monitored by the bulb controller 340 (step 420). If bulb B1 fails (step 430=YES), bulb controller 340 turns on bulb B2 (step 440) by activating switch 330B. If bulb B1 is good (step 430=NO) but bulb B3 fails (step 460=YES), bulb controller 340 turns on bulb B4 (step 470) by activating switch 330D. Once a reserve bulb has been turn on in step 440 or step 470, a red LED is blinked alternatively on and off (step 450) to provide a visual warning that a bulb has failed. the light fixture 300 and method 400 thus provide two reserve (or redundant) bulbs that may be illuminated should one or both of the primary bulbs fail. Note that if both B1 and B2 fail, both of bulbs B3 and B4 may be illuminated at the same time to compensate for the failures of bulbs B3 and B4. This shows the flexibility provided by individually monitoring the bulbs and individually illuminating each bulb or defined groups of bulbs.

Figure 5:
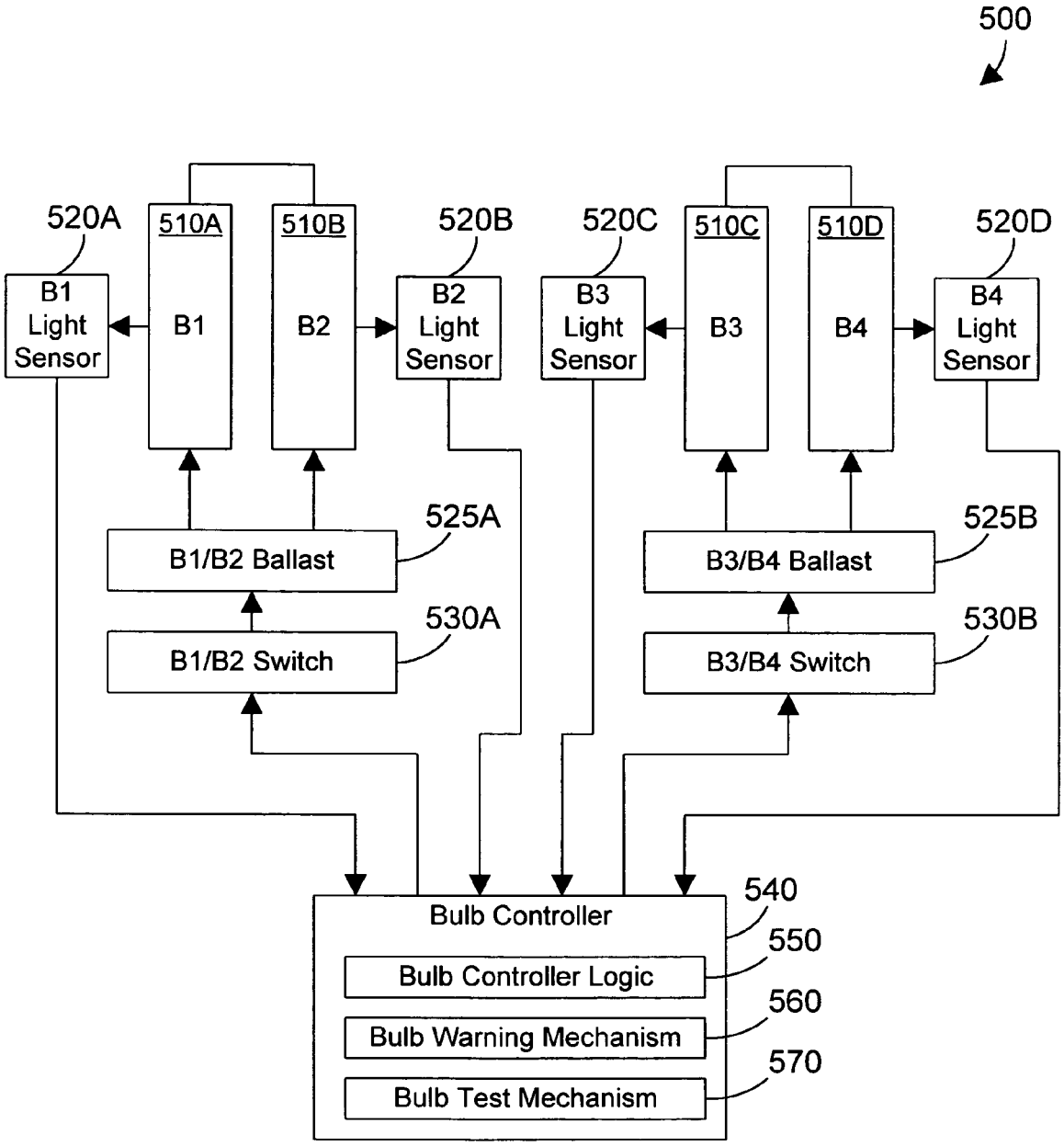
FIG. 5 is a block diagram of a light fixture for fluorescent bulbs in accordance with the preferred embodiments.
Figure 6:
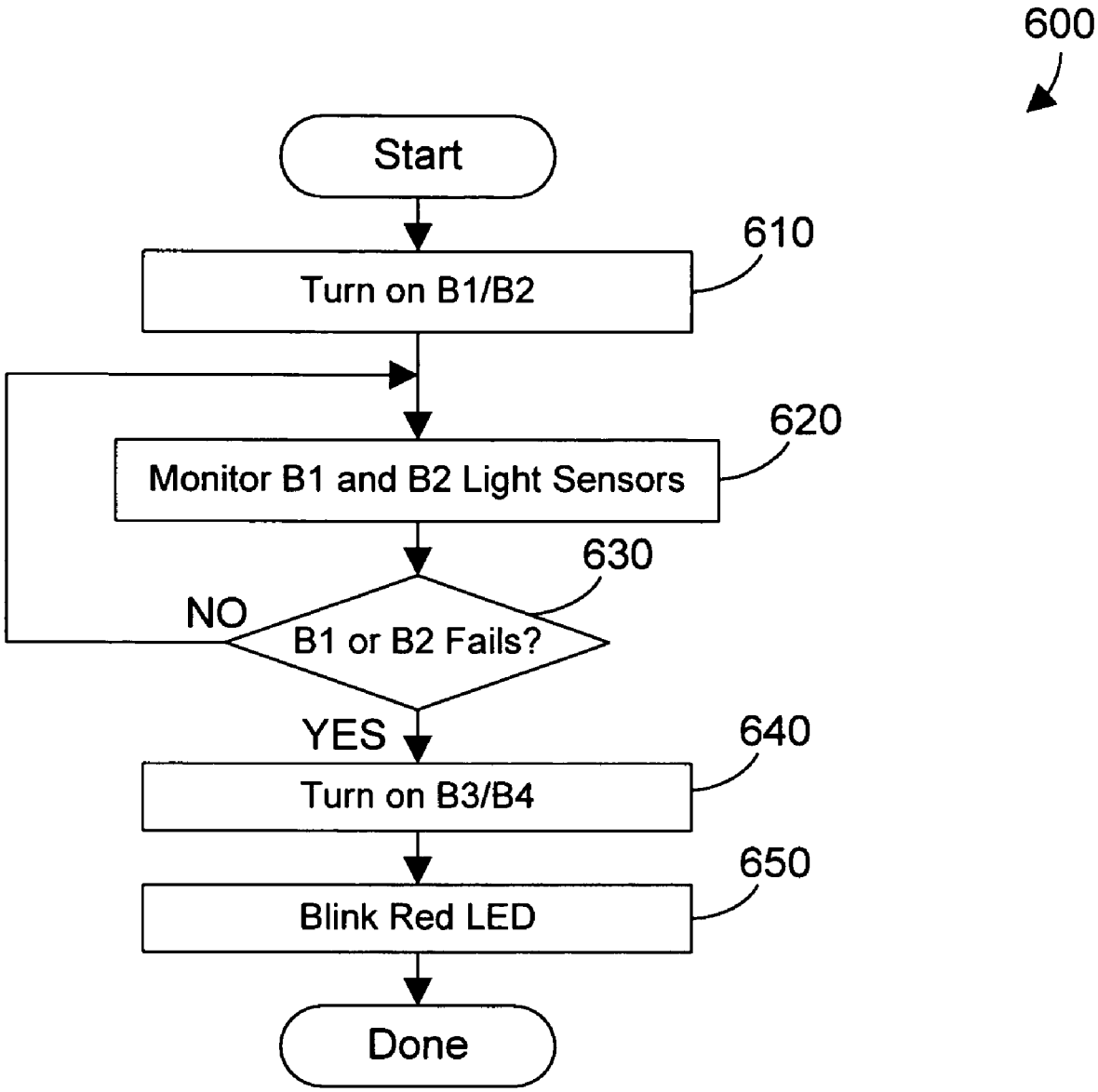
FIG. 6 is a flow diagram of a method in accordance with the preferred embodiments for the bulb controller of FIG. 5.

FIGS. 5 and 6 show another sample light fixture and method for fluorescent bulbs. Referring to FIG. 5, a fluorescent light fixture 500 in accordance with the preferred embodiments includes four bulbs B1-B4 (510A-510D). Bulbs B1 and B2 are connected in series to a ballast 525A, as is common in the art of fluorescent light fixtures. In similar fashion, bulbs B3 and B4 are connected in series to a ballast 525B. Each bulb has a corresponding light sensor to detect when a bulb fails. Thus, bulb B1 has a corresponding light sensor 520A; bulb B2 has a corresponding light sensor 520B; bulb B3 has a corresponding light sensor 520C; and bulb B4 has a corresponding light sensor 520D. In known fluorescent light fixtures, it is common to have a bulb dim when it fails without completely turning off. For this reason, the light sensors 520A-520D are preferably calibrated to output one logic state indicating an illuminated bulb with full light output, and to output a different logic state when the amount of detected light falls below some predetermined threshold, thereby indicating a failure when a bulb dims or goes off.

Because bulbs B1 and B2 are connected in series to ballast 525A, both of these bulbs B1 and B2 may be illuminated by activating a switch 530A that controls the application of power to ballast 525A. In similar fashion, bulbs B3 and B4 may both be illuminated by activating a switch 530B that controls the application of power to ballast 525B. We assume for this example that bulbs B1 and B2 are initially illuminated, with bulbs B3 and B4 held in reserve (i.e., not initially illuminated).

We now refer to FIG. 6 to discuss a method 600 in accordance with the preferred embodiments for the bulb controller logic 550 shown in FIG. 5. Initially, bulbs B1 and B2 are illuminated (step 610) by activating the B1/B2 switch 530A. The outputs of the light sensors 520A and 520B will initially indicate that bulbs B1 and B2, respectively, are illuminated, while the outputs of the light sensors 520C and 520D will initially indicate that bulbs B3 and B4, respectively, are not illuminated. The bulb controller 540 monitors the outputs of the B1 and B2 light sensors (520A and 520B) (step 620). If the light sensors 520A or 520B indicate that either of B1 or B2 has failed (step 630=YES), bulbs B3 and B4 are turned on (step 640) by activating the B3/B4 switch 530B, which then applies power to the B3/B4 ballast 525B. A red LED is then blinked (step 650) to warn that one or both of bulbs B1 and B2 have failed. Light fixture 500 and method 600 show that groups of bulbs may be illuminated together, while still monitoring failure of each bulb individually.

A light fixture in accordance with the preferred embodiments includes one or more bulbs that are initially illuminated, and one or more bulbs that are held in reserve. When one a bulb fails, one or more reserve bulbs are illuminated to compensate for the failure. In this manner, a light fixture automatically detects a bulb failure and switches to a bulb that is still good, thereby providing a light output that remains consistent even when a bulb fails.

One skilled in the art will appreciate that many variations are possible within the scope of the present invention. Thus, while the invention has been particularly shown and described with reference to preferred embodiments thereof, it will be understood by those skilled in the art that these and other changes in form and details may be made therein without departing from the spirit and scope of the invention.

What is claimed is:

1. A controller for a fluorescent light fixture having first, second, third and fourth fluorescent bulbs, the controller comprising:

a first light sensor that detects light from the first fluorescent bulb and outputs a first logic state when an amount of detected light from the first fluorescent bulb is above a predetermined threshold and outputs a second logic state when the amount of detected light from the first fluorescent bulb is below the predetermined threshold;

a second light sensor that detects light from the second fluorescent bulb and outputs the first logic state when an amount of detected light from the second fluorescent bulb is above the predetermined threshold and outputs the second logic state when the amount of detected light from the second fluorescent bulb is below the predetermined threshold;

a first switch mechanism that controls when the first and second fluorescent bulbs are illuminated by applying power simultaneously to the first and second fluorescent bulbs;

a second switch mechanism that controls when the third and fourth fluorescent bulbs are illuminated by applying power simultaneously to the third and fourth fluorescent bulbs;

a visible warning light that is activated to indicate when one of the first and second fluorescent bulbs has failed; and a controller mechanism that activates the first switch mechanism to apply power simultaneously to the first and second fluorescent bulbs until the first light sensor outputs the second logic state to indicate the first fluorescent bulb has failed when the second light sensor outputs the first logic state to indicate the second fluorescent bulb has not failed, and in response to the second logic state from the first light sensor, the controller mechanism deactivates the first switch mechanism to remove power simultaneously from the first and second fluorescent bulbs, activates the second switch mechanism to apply power simultaneously to the third and fourth fluorescent bulbs, and activates the visible warning light.

2. A light fixture comprising:

first, second, third and fourth fluorescent bulbs;

a first light sensor that detects light from the first fluorescent bulb and outputs a first logic state when an amount of detected light from the first fluorescent bulb is above a predetermined threshold and outputs a second logic state when the amount of detected light from the first fluorescent bulb is below the predetermined threshold;

a second light sensor that detects light from the second fluorescent bulb and outputs the first logic state when an amount of detected light from the second fluorescent bulb is above the predetermined threshold and outputs the second logic state when the amount of detected light from the second fluorescent bulb is below the predetermined threshold;

a first switch mechanism that controls when the first and second fluorescent bulbs are illuminated by applying power simultaneously to the first and second fluorescent bulbs;

a second switch mechanism that controls when the third and fourth fluorescent bulbs are illuminated by applying power simultaneously to the third and fourth fluorescent bulbs;

a visible warning light that is activated to indicate when one of the first and second fluorescent bulbs has failed; and a controller mechanism that activates the first switch mechanism to apply power simultaneously to the first and second fluorescent bulbs until the first light sensor outputs the second logic state to indicate the first fluorescent bulb has failed when the second light sensor outputs the first logic state to indicate the second fluorescent bulb has not failed, and in response to the second logic state from the first light sensor, the controller mechanism deactivates the first switch mechanism to remove power simultaneously from the first and second fluorescent bulbs, activates the second switch mechanism to apply power simultaneously to the third and fourth fluorescent bulbs, and activates the visible warning light.

3. A method for illuminating first, second, third and fourth fluorescent bulbs in a fluorescent light fixture, the method comprising the steps of:

applying power simultaneously to the first and second fluorescent bulbs;

detecting a first amount of light from the first fluorescent bulb;

detecting a second amount of light from the second fluorescent bulb; and when the detected first amount of light from the first fluorescent bulb is below a predetermined threshold and the detected second amount of light from the second fluorescent bulb is above the predetermined threshold, removing power simultaneously from the first and second fluorescent bulbs, and applying power simultaneously to the third and fourth fluorescent bulbs; and activating a visible warning light to indicate one of the first and second fluorescent bulbs has failed.

* * * * *